US005193475A

United States Patent [19]

Zovko

[11] Patent Number: 5,193,475

[45] Date of Patent: Mar. 16, 1993

[54] THRUST EXPANSION ENGINE

[75] Inventor: Carl T. Zovko, Silver Spring, Md.

[73] Assignee: The United States of America as represented by the Secretary of the Navy, Washington, D.C.

[21] Appl. No.: 891,027

[22] Filed: Jun. 1, 1992

[51] Int. Cl.[5] ..... F42B 19/00

[52] U.S. Cl. ..... 114/20.2; 60/221; 60/222; 440/5; 440/44

[58] Field of Search ..... 114/20.2; 60/201, 221, 60/222; 440/5, 39, 44, 45

[56] References Cited

U.S. PATENT DOCUMENTS 2,943,440 7/1960 Andras ..... 60/221
3,783,141 1/1974 Zovko ..... 114/20.2
3,872,665 3/1975 Jarry ..... 60/221
3,951,094 4/1976 Jastram et al. ..... 60/221

*Primary Examiner*—J. Woodrow Eldred
*Attorney, Agent, or Firm*—Kenneth E. Walden; Jacob Shuster

[57] ABSTRACT

Break-up activity of water by injection of hot propellant gas into channels of a thrust expansion engine is suppressed to prevent rapid cooling of the gas, utilizing one or more methods including injection of a secondary inflow of the propellant gas and/or the water under lower pressures into the channels, injection of a viscosity enhancer and/or surfactant into the inflow stream of the water and restricting outflow of the water from the channels by means of convergent nozzles.

26 Claims, 3 Drawing Sheets

THRUST EXPANSION ENGINE

BACKGROUND OF THE INVENTION

This invention relates to thrust generating engines of the fluid expansion type for propelling a body through a fluid medium such as sea water and more particularly to underwater propulsion engines for torpedoes as disclosed in my prior U.S. Pat. No. 3,783,814, issued Jan. 8, 1974.

The foregoing type of propulsion engine involves the acceleration of water during passage through channels in the engine rotor. The inlet ends of the channels are opened and closed in response to rotation of the engine rotor, such rotation being induced by flow of the water along the helical paths of the channels to control cyclic intake into, filling of and outflow of the water from the channels. A pressurized propellant gas is injected into the inlet ends of the channels to accelerate the columns of water in the channels toward the exit ends. Expansion of the propellant gas at the inlet ends of the channels induces said acceleration of the water and resulting axial propelling thrust during its outflow from the exit ends of the channels.

Practical underwater applications of the foregoing type of propulsion engines are associated with a source of hot propellant gas. During injection of the gas into the engine channels, it was discovered that rapid cooling of the gas occurs with resultant high loss of energy to substantially offset the otherwise advantageous attributes of the engine. Such rapid cooling rate could not heretofore be explained by heat transfer through the gas-water interface adjacent to the inlet ends of the rotor channels. It is known that cavitation bubbles will form at the inlet ends of the channels when the water inflow is cut off. Such cavitation bubbles become attached to the flow blocking section of the engine body and the propellant gas has heretofore been injected into the bubble cavities. Apparently, rarefaction wave flow from the cavitation bubbles into the enclosing water mass causes the water to accelerate toward such bubbles and breaks the water up into many smaller bubbles or droplets, thereby increasing the interface surface area and the cooling rate.

It is therefore an important object of the present invention to substantially reduce the cooling rate of hot propellant gas injected into the columns of fluid medium filling the channels of an expansion thrust engine, whereby engine operation may be achieved with greater efficiency.

An additional object of the invention in accordance with the foregoing object is to reduce the cooling rate of hot propellant gas within the channels of an underwater propulsion engine by reducing water foaming activity during injection of such gas into the channels.

SUMMARY OF THE INVENTION

In accordance with the present invention one or more methods are utilized to suppress the break up of water columns flowing through helical channels in the rotor of a thrust producing engine propelled through the water so as to avoid the resultant increase in cooling rate of hot propellant gas. The rotor of such an engine is in slide bearing contact at its forward axial end with a bearing portion of the engine block projecting from an annular face thereon. Radially extended, inflow blocking formations of the engine block terminating at said annular face are in abutment with an axial end of the rotor at which the inlet ends of the channels are located so as to cyclically control intake and filling of the channels with columns of water directed thereto between the aforementioned radial inflow blocking formations of the engine block. Cavitation bubbles formed in the water within such channels adjacent to the inlet ends are filled with the propellant gas in response to the injection thereof into the channels.

One of the aforementioned methods of suppressing the water break-up activity, involves the injection of a viscosity enhancer into the stream of water entering the rotor channels before cut-off by the radial inflow blocking sections of the engine block. The viscosity enhancer is in the form of a chemical additive or a surfactant such as polyethylene oxide, according to one embodiment of the invention.

Another method of eliminating or reducing the water break up activity involves a secondary inflow of pressurized water into the channel. According to one embodiment, the secondary inflow occurs from a port in each of the inflow blocking sections of the engine block adjacent to the propellant gas injection port. According to another embodiment of the invention, the propellant gas injection site is located in a conical bearing surface of the engine block from which the propellant gas is conducted radially outward into the channels through passages in the rotor spaced downstream of the channel inlet ends. High cavitation bubble pressure is thereby maintained until bubble collapse occurs before any bubble break-up is possible.

Another method of preventing bubble break-up according to the invention involves substantially equalizing the cavitation bubble pressure with that of the external inflow pressure of the water conducted through the rotor channels to effect bubble ventilation. Such bubble ventilation is achieved by secondary injection of propellant gas at a lower pressure either from a separate low pressure gas source, or by bleeding the gas from the primary injection inflow, or by diverting expanded propellant gas from one channel to inject it into another channel at the lower pressure in advance of primary injection of the propellant gas under the higher pressure.

According to yet another method, gas cooling is eliminated or reduced by formation of convergent nozzles at the exit ends of the rotor channels. The cavitation bubbles may thereby be eliminated to prevent foaming by establishment of varying pressure gradients within the water columns filling the channels, dependent on the nozzle area ratios of the channel exit nozzles.

BRIEF DESCRIPTION OF THE DRAWING FIGURES

Other objects, advantages and novel features of the invention will become apparent from the following detailed description of the invention when considered in conjunction with the accompanying drawing wherein.

DETAILED DESCRIPTION OF PREFERRED EMBODIMENTS

Figure 1:
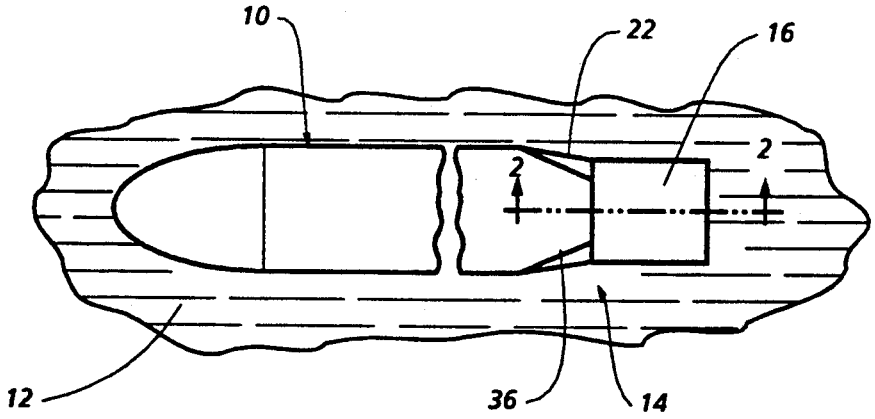
FIG. 1 is a side elevation view of an underwater propelled torpedo equipped with a thrust expansion engine in accordance with one embodiment of the present invention.
Figure 2:
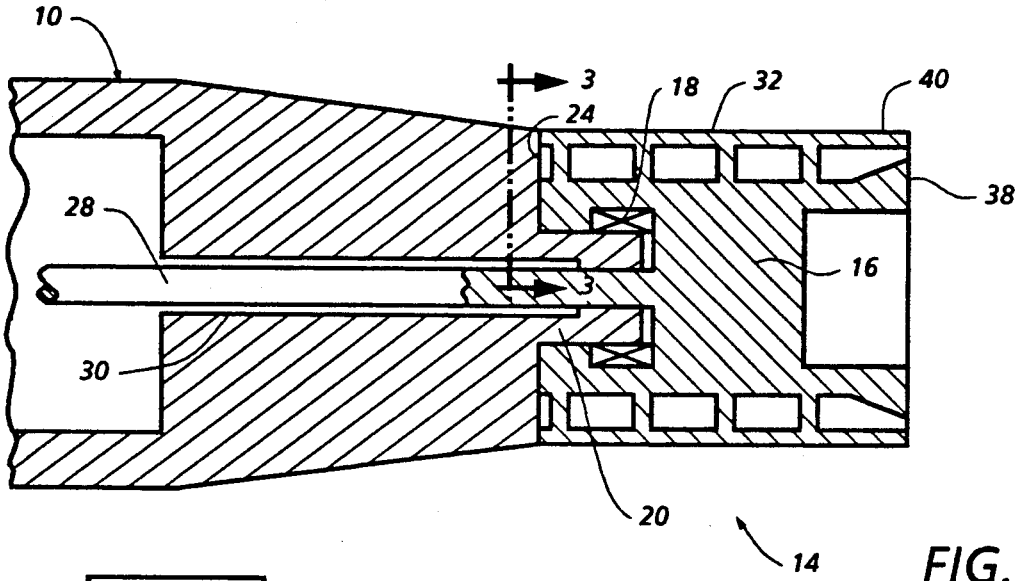
FIG. 2 is an enlarged partial section view taken substantially through a plane indicated by section line 2—2 in FIG. 1.

Referring now to the drawing in detail, FIG. 1 illustrates a torpedo body 10 being propelled through seawater as the fluid medium 12 by means of an expansion thrust engine 14 located at the aft end portion of the torpedo body. As more clearly seen in FIG. 2, the engine 14 includes a rotor 16 rotationally supported by bearings 18 on a bearing portion 20 of the body 10 projecting axially from a rear end thereof. The rear end of the body 10 at the engine 14 has radially extending flow blocking formations in the form of arcuate sections 22, one of which is shown in detail in FIG. 3. The sections 22 have planar aligned end faces 24 in slide bearing abutment with the forward end of the rotor 16, as shown in FIG. 2. A drive shaft 28 projects from the rotor 16 centrally through an axial bore 30 formed in the body 10. The shaft 28 connects rotor 16 to one or more engine operating components as will be explained hereinafter.

The radially outer portion of rotor 16 is formed with a plurality of helical channels 32 as described in greater detail in my prior U.S. Pat. No. 3,783,814, aforementioned. The inlet ends 34 of the channels are exposed between the arcuate sections 22 for inflow of the fluid medium or water 12, such inflow being blocked when the end faces 24 of the sections 22 are in slide bearing abutment with the rotor 16 as more clearly seen in FIG. 4. Accordingly, inflow of water into the channels 32 will be cyclically cut-off at the inlet ends 34 by the flow blocking sections 22 during rotation of the rotor. Flow streams of the water are conducted to such inlet ends of the channels 32 between the flow blocking sections 22. Outflow of the water from the channels at the rear end 38 of the rotor, on the other hand, is regulated by convergent nozzle formations 40, according to the embodiment illustrated in FIG. 2, for purposes to be explained hereinafter.

Figure 3:
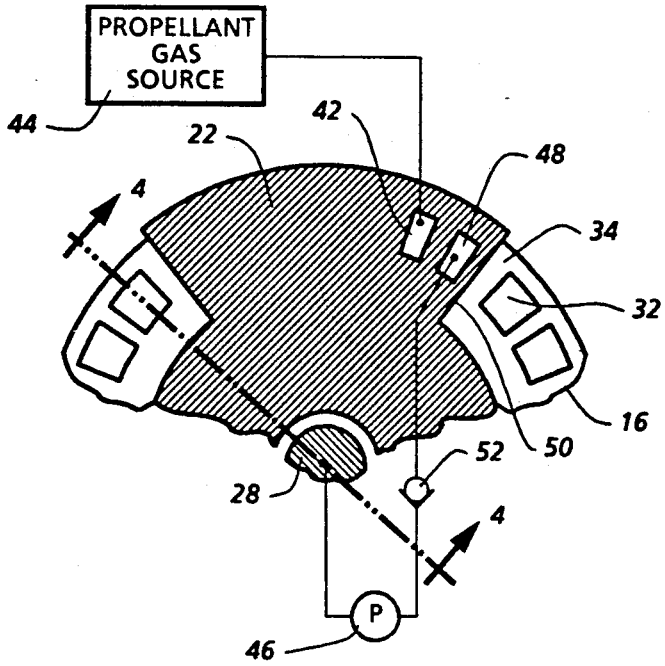
FIG. 3 is a partial transverse section view taken substantially through a plane indicated by section line 3—3 in FIG. 2.
Figure 4:
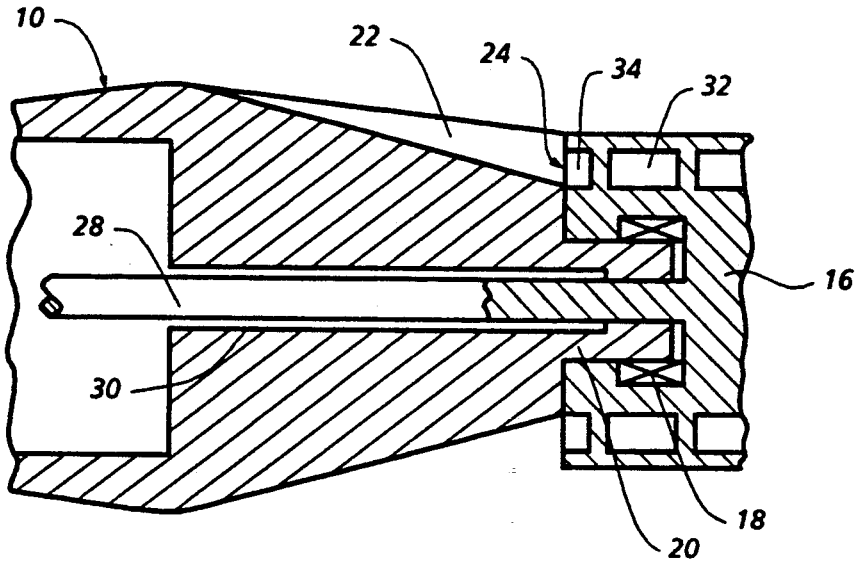
FIG. 4 is a partial section view taken substantially through a plane indicated by section line 4—4 in FIG. 3.

According to the embodiment of the invention illustrated in FIGS. 3 and 4, propellant gas under a high pressure is injected into the inlet ends 34 of the channels 32 following filling of the channels with the water. Injection is effected through a gas injection port 42 in each of sections 22 connected to source 44 as schematically diagrammed in FIG. 3. During water inflow cut-off in a given channel, a cavitation bubble is formed in the water adjacent to the rear face 24 on the section 22 blocking the inlet end of such channel. The high pressure propellant gas vents into the cavitation bubble, enlarging it, as it accelerates the water filling the channels by expansion to produce the axial propelling thrust. Accelerated flow of the water through the helical paths of the channels 32 induces rotation of the rotor 16 to control cyclic cut-off of the inflow streams of water into the inlet ends of the channels. Such rotation of the rotor 16 is transmitted by drive shaft 28 to operate components such as a water pump 46 schematically diagrammed in FIG. 3.

Where the propellant from source 44 is a hot gas, recent tests have shown that it was cooled so rapidly that the cooling rate could not be explained by heat transfer contact at the heretofore expected small gas-water interface between the hot propellant gas and the water filling the channels. It was accordingly concluded that the water adjacent to the gas is broken up into many small droplets or a foam with a corresponding increase in heat transfer contact surface area. Such bubble break-up occurs because a significant portion of the total inflow pressure is retained by the body of water adjacent to and externally of each cavitation bubble having very low internal pressure causing a rarefaction wave to be emitted from the bubble into the water. As a result, local acceleration of the water into the cavitation bubbles causes break up thereof into the many small droplets or foam. The rapid cooling rate problem arising because of the filling of such cavitation bubbles with hot propellant gas is solved in accordance with the present invention by suppressing the foregoing water break-up phenomenum involving spraying and/or foaming activity.

One method of suppressing water spraying/foaming activity in accordance with the present invention involves secondary inflow of water into the channels under a pressure higher than the external inflow pressure of the primary inflow streams in passages 36. Such secondary inflow is effected through a high pressure water port 48 formed in each inflow blocking section 22 between the leading edge 50 thereof and the propellant gas injection port 42 as shown in FIG. 3. The water pump 46, driven by rotor shaft 28 aforementioned, is connected by a check valve 52 to the port 48 as depicted to prevent back flow of the propellant gas from injection port 42 when it is subsequently aligned with the channel inlet 34 into which the secondary inflow of pressurized water was injected through port 48. If the secondary inflow is sufficient, formation of the cavitation bubble and the foaming/spraying activity resulting therefrom can be prevented.

Figure 5:
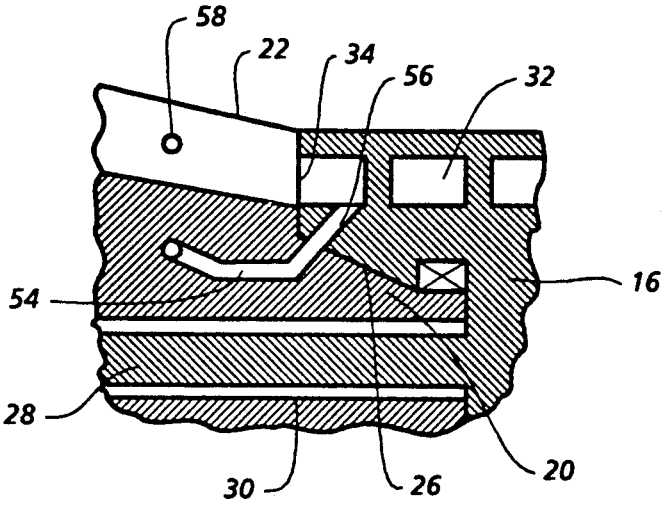
FIG. 5 is a partial section view similar to that of FIG. 4, but showing a modification thereof in accordance with another embodiment of the invention.

According to another embodiment of the invention as depicted in FIG. 5, filling of the cavitation bubbles formed at the channel inlet end 34, within the rotor 16, with hot propellant gas is avoided by an alternative location of the gas injection site replacing the gas injection port 42 shown in FIG. 3. Thus, FIG. 5 shows a gas injection passage 54 in the body 10 connected to the propellant gas source, and terminating at a conical surface 26 of the rotor supporting bearing portion spaced radially inward from the channels. A radial gas injection passage 56 formed in the rotor 16 is connected to each channel closely spaced upstream from its inlet end 34. The passages 56 are cyclically aligned, by rotation of the rotor, with the terminal ends of the gas injection passages 54 at the conical bearing surface 26, as shown in FIG. 5, for injection of the hot propellant gas. The propellant gas is thereby injected directly into the water within the rotor channels 32 downstream from the cavitation bubbles formed at the inlet ends 34. High pressure bubbles are accordingly formed in the water by the hot propellant gas to collapse the upstream formed cavitation bubbles and prevent the foaming/spraying action aforementioned.

Suppression of foaming action may also be achieved in accordance with another method by injecting a surfactant into the inflow stream of the water entering the inlet ends of the channels 32. Thus, as shown in FIG. 5 a chemical additive including surfactants such as polyethylene oxide, is injected into the inflow streams through an injection port 58 spaced upstream from the inlet ends 34 of the channels. Sufficient additive thereby injected into the inflow stream entering the channels before cut-off, will modify the water to prevent foaming and rapid cooling of the subsequently injected propellant gas. If water break-up occurs as result of a spraying action, then a viscosity enhancer such as guar gums may be used as the chemical additives.

Figure 7:
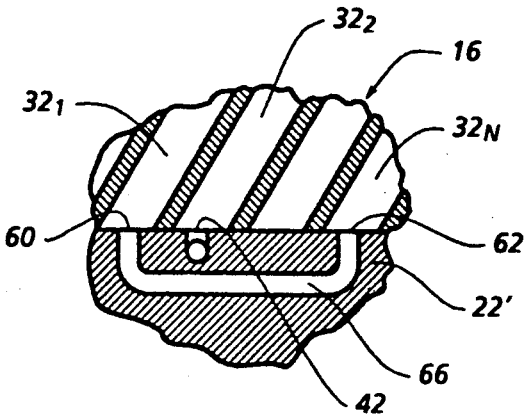
FIG. 7 is a partial section view taken substantially through a plane indicated by section line 7—7 in FIG. 6.
Figure 6:
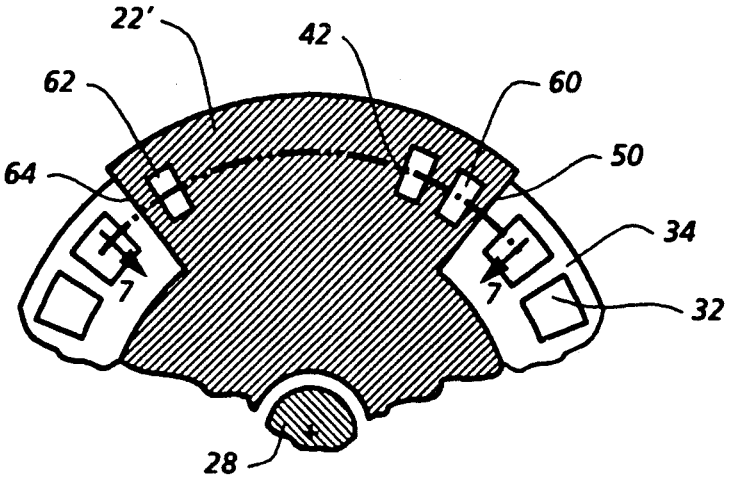
FIG. 6 is a partial section view similar to that of FIG. 3, but showing yet another embodiment of the invention.

By means of yet another method, in accordance with the present invention, foaming is suppressed by increasing the internal pressure of the cavitation bubbles formed at the inlet ends of the channels 32 to approximately that of the inflowing water so as to effect bubble ventilation. Toward that end, a secondary inflow of propellant gas at a lower pressure is injected into the channels in advance of the primary injection of the gas under higher pressure. The latter bubble ventilation method may be achieved by injecting the lower pressure propellant gas from a source separate from the high pressure gas source. Alternatively, the low pressure gas may be derived from the same high pressure source either by some bleeding action or by diverting channel expanded gas as illustrated in FIGS. 6 and 7. As shown in FIGS. 6 and 7, a modified form of water inflow blocking section 22' is utilized in the engine 14 as hereinbefore described, wherein a low pressure gas injection port 60 is formed in each inflow blocking section 22' in place of the high pressure secondary water inflow port 48 shown in FIG. 3. Further, a third gas diversion port 62 is formed in section 22' closer to its trailing edge 64 as shown in FIG. 6. A low pressure diversion passage 66 is formed in each section 22' between ports 62 and 60 as shown in FIG. 7 in order to conduct expanded propellant gas from one channel $32_n$ to another channel $32_1$ in advance of channel $32_2$ into which the high pressure propellant gas is injected through port 42.

Figure 8:
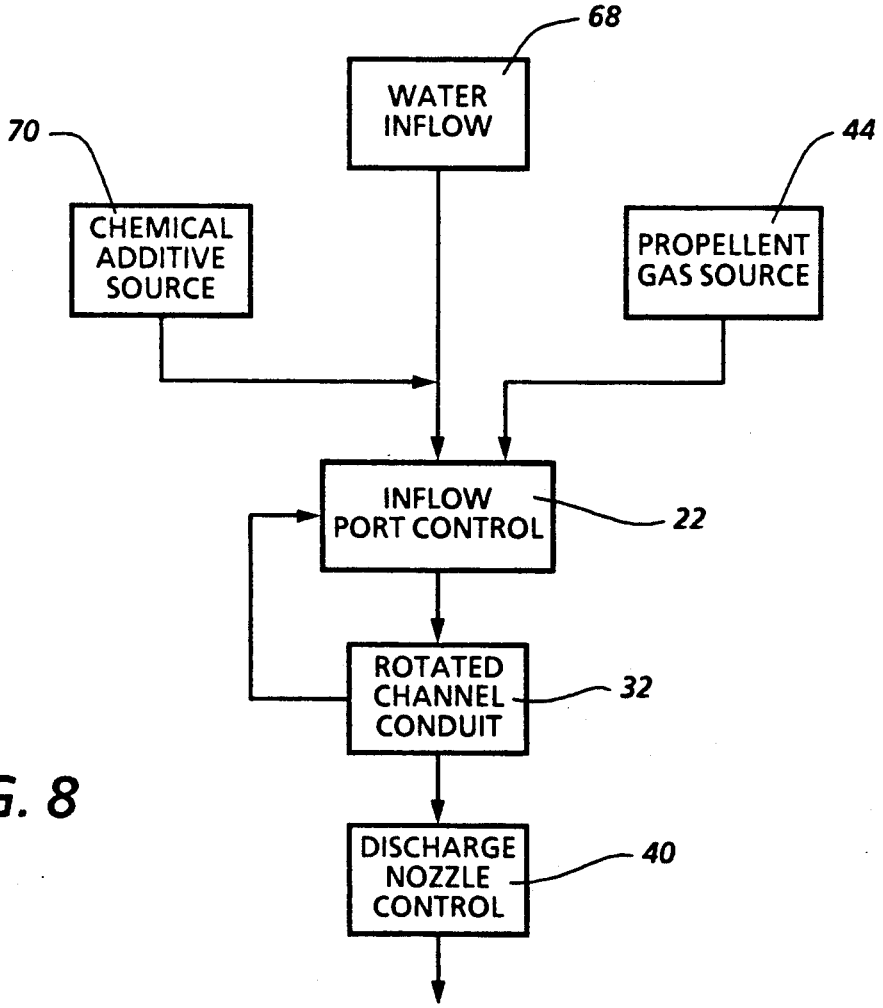
FIG. 8 is an operational program diagram associated with the present invention.

One or more of the spray/foam suppressing methods hereinbefore described may be utilized pursuant to the present invention as summarized by the operational program diagram of FIG. 8 depicting the propellant gas source 44, from which the high pressure propellant gas is injected through ports in the inflow control section 22 into the water within a rotating channel 32 after inflow cut-off. Water inflow denoted by diagram block 68 in FIG. 8 is conducted under control of section 22 into a rotating channel 32. The viscosity enhancer may be introduced into the water before inflow into a channel through the control section 22 from a chemical additive source as depicted by diagram block 70 in FIG. 8. Finally, the convergent discharge nozzle 40 diagrammed in FIG. 8 and shown in FIG. 2 restricts the outflow of the water from the rotating channel. While the inflowing water is filling the channel, the nozzle 40 has a negligible effect until the channel water column enters the upstream end of the nozzle causing an increase in its velocity and a rise in pressure thereat. Such rise in pressure produces a pressure gradient within the water column to decrease water inflow velocity at the upstream end of the channel tending to eliminate cavitation bubbles. To avoid any cyclic inefficiency, a variable hinge type nozzle may be utilized having a nozzle area ratio varied during each operational cycle between an extreme area ratio at the beginning of a cycle (initiated upon unblocking of inflow) and an appropriate moderate area ratio for the remainder of the cycle.

Numerous other modifications and variations of the present invention are possible in light of the foregoing teachings. It is therefore to be understood that within the scope of the appended claims the invention may be practiced otherwise than as specifically described.

I claim:

1. In combination with an engine for propelling a body through a surrounding medium, including a rotor having a plurality of channels formed therein through which the medium is conducted between inlet and outlet ends, a source of propellant gas, means for injection of the propellant gas under pressure into the medium at said inlet ends of said channels to accelerate flow therethrough, control means responsive to rotation of the rotor relative to the body for cyclically controlling said injection of the propellant gas and inflow of the medium into the channels at the inlet ends and means for suppressing foaming of the medium within the channels resulting from formation of cavitation bubbles to inhibit increase in rate of cooling of the propellant gas.

2. The combination as defined in claim 1 wherein said means for inhibiting includes a source of chemical additive having a viscosity enhancing property and means for injecting said additive into the medium externally of the rotor during said inflow thereof into the channels.

3. The combination as defined in claim 2 wherein said means for inhibiting further includes a pressurizing pump and secondary inflow means connected to said pump for injecting the medium pressurized by the pump into the channels.

4. The combination as defined in claim 3 wherein said control means includes a flow blocking formation on said body in abutment with the rotor, said means for injecting the propellant gas and the secondary inflow means respectively including injection ports formed in the flow blocking formation adjacent to each other through which the propellant gas and the pressurized medium are respectively injected into the channels.

5. The combination as defined in claim 4 wherein said means for inhibiting still further includes bubble ventilation means for substantially equalizing pressure of the cavitation bubbles and the medium externally of the rotor during said inflow thereof into the channels.

6. The combination as defined in claim 5 wherein said bubble ventilation means includes additional means for secondary injection of the propellant gas at a lower pressure into the channels.

7. The combination as defined in claim 6 wherein said means for inhibiting also includes convergent nozzle means through which the medium is discharged from the channels for establishing varying pressure gradients within columns of the medium respectively filling the channels to suppress said formation of the cavitation bubbles.

8. In combination with an engine for propelling a body through a surrounding medium, including a rotor having a plurality of channels formed therein through which the medium is conducted, a source of propellant gas under pressure, means for injecting the propellant gas at a high pressure into the medium conducted through said channels to accelerate flow therethrough, control means responsive to the rotation of the rotor relative to the body for cyclically controlling inflow of the medium into the channels within which cavitation bubbles are formed and means for inhibiting increase in rate of cooling of propellant gas by the medium within the channels resulting from said formation of the cavitation bubbles, the means for inhibiting including a pressurizing pump and secondary inflow means connected to said pump for injecting the medium pressurized by the pump into the channels.

9. The combination as defined in claim 8 wherein said control means includes a flow blocking formation on said body in abutment with the rotor, said means for injecting the propellant gas and the secondary inflow means respectively including injection ports formed in the flow blocking formation adjacent to each other through which the propellant gas and the pressurized medium are respectively injected into the channels to suppress said formation of the cavitation.

10. In combination with an engine for propelling a body through a surrounding medium, including a rotor having a plurality of channels formed therein through which the medium is conducted, a source of propellant gas under pressure, means for injecting the propellant gas at a high pressure into the medium conducted through said channels to accelerate flow therethrough, control means responsive to rotation of the rotor relative to the body for cyclically controlling inflow of the medium into the channels within which cavitation bubbles are formed and means for inhibiting increase in rate of cooling of the propellant gas by the medium within the channels resulting from said formation of the cavitation bubbles, said means for inhibiting including convergent nozzle means through which the medium is discharged from the channels for establishing varying pressure gradients within columns of the medium respectively filling the channels.

11. In combination with an engine for propelling a body through a surrounding medium, including a rotor having a plurality of channels formed therein through which the medium is conducted, a source of propellant gas under pressure, means for injecting the propellant gas at a high pressure into the medium conducted through said channels to accelerate flow therethrough, control means responsive to rotation of the rotor relative to the body for cyclically controlling inflow of the medium into the channels within which cavitation bubbles are formed and means for inhibiting increase in rate of cooling of the propellant gas by the medium within the channels resulting from said formation of the cavitation bubbles, said means for inhibiting including bubble ventilation means for substantially equalizing pressure of the cavitation bubbles and the medium externally of the rotor during said inflow thereof into the channels.

12. The combination as defined in claim 11 wherein said bubble ventilation means includes additional means for secondary injection of the propellant gas at a lower pressure into the channels.

13. The combination as defined in claim 12 wherein said control means includes a flow blocking formation on said body in abutment with the rotor, said additional means for secondary injection of the propellant gas at the lower pressure including flow diverting passage means in said flow blocking formation for conducting the propellant gas between two of the channels after expansion, said means for injection of the propellant gas at the high pressure including an injection port formed in the flow blocking formation in communication with another of the channels between said two of the channels.

14. The combination as defined in claim 1 wherein said body includes a bearing portion on which the rotor is rotationally supported, and said means for suppressing foaming includes a gas passage in the rotor through which the propellant gas is conducted to the channels downstream from the inlet ends thereof.

15. In combination with an engine for propelling a body through a surrounding medium, including a rotor having a plurality of channels formed therein through which the medium is conducted, a source of propellant gas under pressure, means for injecting the propellant gas under pressure into the medium conducted through said channels, including a gas injection port, control means responsive to rotation of the rotor relative to the body for cyclically controlling inflow of the medium into the channels and means for inhibiting increase in rate of cooling of the propellant gas by the medium, said channels having inlet ends through which the control means blocks the inflow of the medium, said means for inhibiting including a gas passage in the rotor through which the propellant gas under pressure is conducted to the channels downstream of the inlet ends thereof, and said gas injection port being formed in the body radially inward of the channels and in fluid communication with the gas passage.

16. A method of reducing rate of cooling of a propellant gas injected under a high pressure into a fluid medium conducted under a lower external inflow pressure through channels of an expansion thrust engine propelling a body through said fluid medium, including the step of: injecting a viscosity enhancer into the fluid medium during inflow thereof into the channels to suppress break-up activity caused by the propellant gas within the channels.

17. The method of claim 16, further including the steps of: pressurizing some of the fluid medium to a pressure higher than said external inflow pressure; and injecting the pressurized fluid medium into the channels as a secondary inflow.

18. The method of claim 17 further including the step of: injecting a secondary inflow of the propellant gas into the channels under a low pressure to substantially equalize pressures of the fluid medium in the channels and in cavitation bubbles within the channels.

19. The method of claim 18 further including the step of: variably restricting outflow of the fluid medium from the channels to establish a pressure gradient therein suppressing formation of the cavitation bubbles.

20. The method of claim 16 wherein the propellant gas is injected into the channels at a location upstream of cavitation bubbles otherwise formed during said inflow of the fluid medium into the channels.

21. A method of reducing rate of cooling of a propellant gas injected under a high pressure into a fluid medium conducted under a lower external inflow pressure through channels of an expansion thrust engine propelling a body through said fluid medium, including the steps of: pressurizing some of the fluid medium to a pressure higher than said external inflow pressure; and injecting the pressurized fluid medium into the channels as a secondary inflow.

22. A method of reducing rate of cooling of a propellant gas injected under a high pressure into a fluid medium conducted through channels of an expansion thrust engine propelling a body through said fluid medium, including the step of: injecting a secondary inflow of the propellant gas into the channels under a low pressure to substantially equalize pressures of the fluid medium in the channels and the propellant gas within cavitation bubbles formed in the channels.

23. The method of claim 22 wherein said secondary inflow of the propellant gas is obtained by bleeding a portion of the propellant gas into the channels prior to injection thereof under said high pressure into the channels.

24. The method of claim 22 wherein said secondary inflow of the propellant gas is obtained by diverting a portion of the propellant gas from the channels after expansion therein.

25. A method of reducing rate of cooling of a propellant gas injected under a high pressure into a fluid medium conducted through channels of an expansion thrust engine propelling a body through said fluid medium, including the the step of: variably restricting outflow of the fluid medium from the channels to establish a pressure gradient therein suppressing formation of cavitation bubbles.

26. A method of reducing rate of cooling of propellant gas entrapped within cavitation bubbles formed in a fluid medium in response to inflow thereof into channels of an expansion thrust engine propelled through said fluid medium, including the steps of: injecting said propellant gas into the channels with the fluid medium during said inflow thereof; and suppressing foaming action within the channels by secondary inflow downstream of the cavitation bubbles formed within the fluid medium during said inflow thereof.

* * * * *